United States Patent [19]

Vilen

[11] 4,286,920

[45] Sep. 1, 1981

[54] PROTECTOR DEVICES FOR DRAINS

[75] Inventor: Erik O. Vilen, La Grange Park, Ill.

[73] Assignee: G. S. Blakeslee & Co., Cicero, Ill.

[21] Appl. No.: 51,619

[22] Filed: Jun. 25, 1979

[51] Int. Cl.[3] ..... F01D 25/00

[52] U.S. Cl. ..... 415/121 G; 134/182; 137/565

[58] Field of Search ..... 415/121 G, 182, 206, 415/207, 213 R, 213 C; 134/182, 183, 188; 137/565, 550; 138/42, 37

[56] References Cited

U.S. PATENT DOCUMENTS

| | | | |
|---|---|---|---|
| 2,100,994 | 11/1937 | Cohen | 415/121 G |
| 2,646,585 | 7/1953 | Whittington | 134/186 |
| 3,108,607 | 10/1963 | Blakeslee | 134/186 |

*Primary Examiner*—Robert E. Garrett

*Attorney, Agent, or Firm*—Emrich, Root, Lee, Brown & Hill

[57] ABSTRACT

A protector device for preventing the passage of elongated members such as silverware, and the like, into a drain outlet, the device having a baffle member mounted within an annular member for the passage of liquid therebetween and with the annular member adapted to be disposed around the drain outlet in axially outwardly spaced relation thereto for the passage of liquid radially inwardly past the annular member into the drain outlet.

11 Claims, 3 Drawing Figures

PROTECTOR DEVICES FOR DRAINS

BACKGROUND OF THE INVENTION

The present invention relates to protector devices for drains or outlet openings, and, more particularly, to protector devices which are particularly well adapted for use in dishwashing machines for guarding against silverware, and the like, entering into the pump used for circulating water through the machine.

A primary object of the present invention is to afford a novel protector device for drains or outlet openings.

Another object is to afford a novel protector device for use in dishwashing machines, and the like, for guarding against silverware and the like from entering the pump used for circulating water through the machine.

Dishwashers heretofore known in the art commonly have had screens in the bottom of the dish-washing compartment thereof for preventing items such as knives, forks and spoons, which might fall off from the conveyor or dish rack, from passing downwardly from the compartment into the pump used to circulate water through the machine. Since these screens have to be cleaned from time to time, to clean the food soil, and the like, therefrom, they normally are made removable and it has been found that, at times, the operator may forget to place the screen back into the machine. When this occurs, silverware, and the like, can pass downwardly into the bottom of the machine where, if the inlet to the pump is unprotected, it can pass into the pump and jam the same or damage the impeller thereof, or the like.

In some instances, dishwashing machines heretofore known in the art have had screens disposed across the inlet to the pump to prevent articles, such as silverware, from passing into the pump. However, because of the relatively inaccesible location of the pump, when such pump screens have been used, it has been found that the operators oftentimes failed to clean them or to clean them as frequently as necessary to maintain good pump operation, with the result that the screens would clog up to a point that the pumps would, at least, not perform properly, and, in some instances, completely cut off the spray action of the machine. It is an important object of the present invention to overcome such disadvantages of dishwashers heretofore known in the art, and to afford a novel protector device for effectively guarding against the passage of articles, such as silverware, into the pump of the machine, and which protector device, normally, does not require cleaning and does not have the disadvantages of the screens, and the like, heretofore known in the art.

Another object of the invention is to enable the inlet of a pump in a dishwashing machine, and the like, to be protected, in a novel and expeditious manner, against the passage of articles, such as silverware, into the pump.

Another object of the present invention is to afford a novel protector device of the aforementioned type, which is particularly well adapted for use on an upright wall in a dishwashing machine, or the like, but which, if desired, may be used on other walls, such as, for example, a bottom wall in such a machine.

A further object of the present invention is to afford a novel protector device of the aforementioned type which has a portion that is readily removable for affording access to the drain opening that it is protecting, in the event that it should become necessary to have such access thereto.

An object ancillary to the foregoing is to afford a novel protector device of the aforementioned type wherein the removable portion thereof is readily replaceable into operative position when it has been removed.

Another object of the present invention is to afford a novel protector device of the aforementioned type which, normally, is self-cleaning.

Another object of the present invention is to afford a novel protector device of the aforementioned type which is practical and efficient in operation, and which may be readily and economically produced commercially.

Other and further objects of the present invention will be apparent from the following description and claims and are illustrated in the accompanying drawings which, by way of illustration, show the preferred embodiment of the present invention and the principles thereof, and what I now consider to be the best mode in which I have contemplated applying these principles. Other embodiments of the present invention embodying the same or equivalent principles may be used and structural changes may be made as desired by those skilled in the art without departing from the present invention and purview of the appended claims.

DESCRIPTION OF THE EMBODIMENT SHOWN HEREIN

Figure 1:
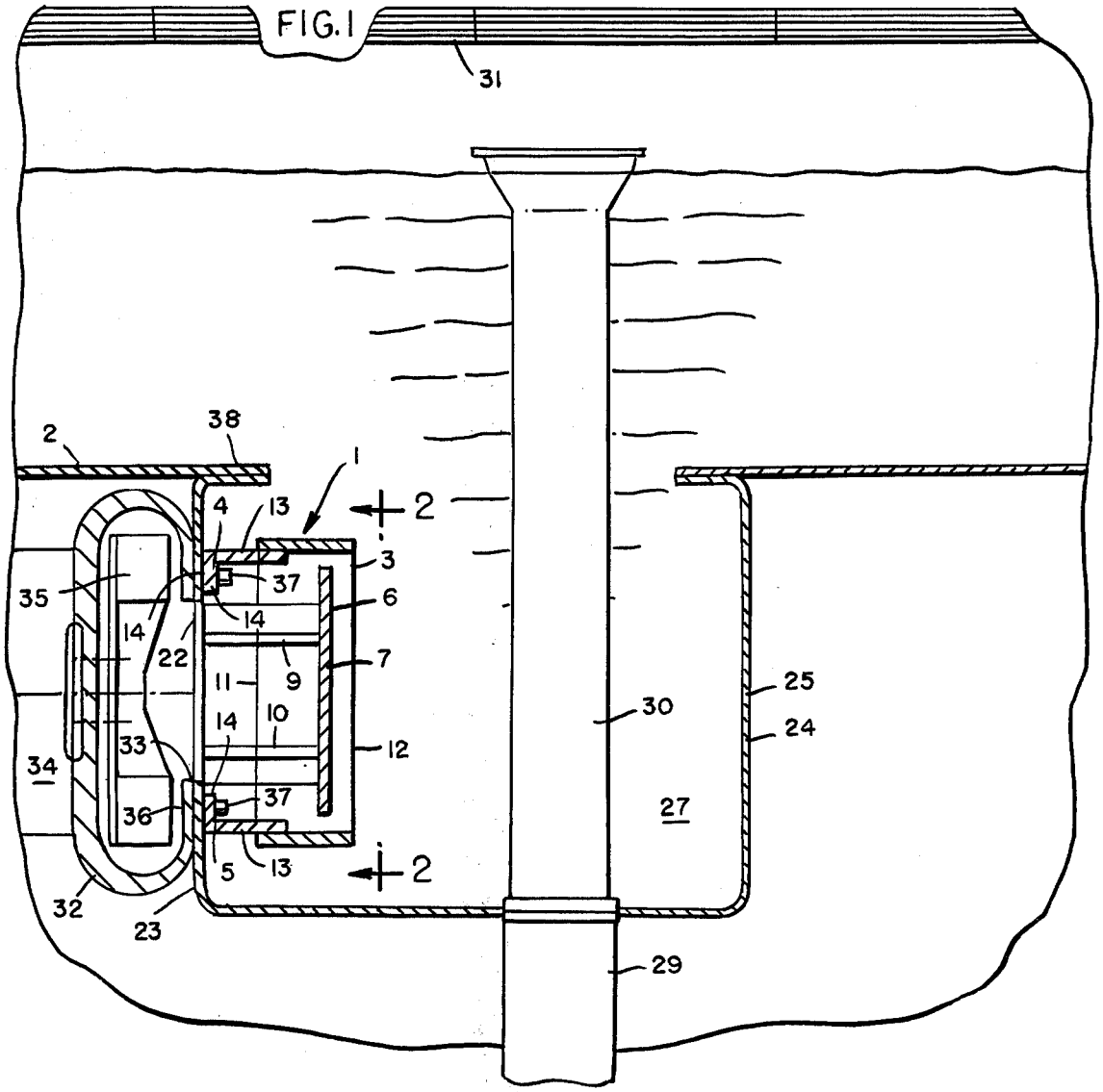
FIG. 1 is a somewhat diagrammatic, internal sectional view of a dishwashing machine having a protector device, embodying the principles of the present invention, mounted in operative position therein.
Figure 2:
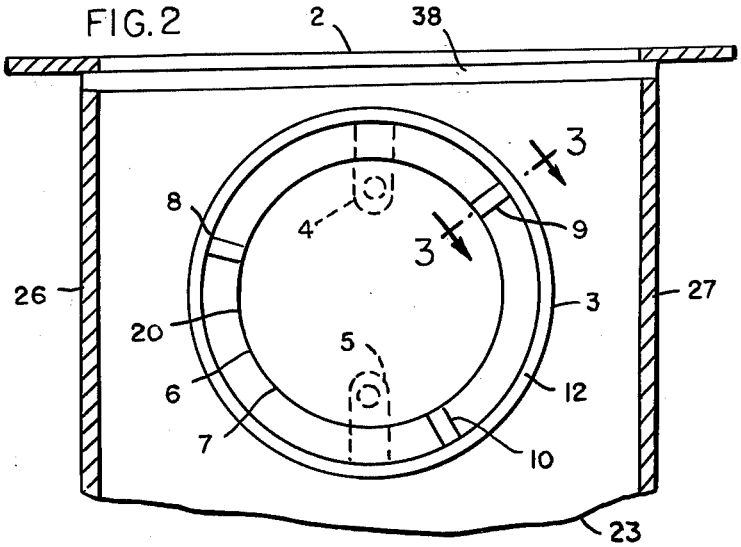
FIG. 2 is a fragmentary, detail sectional view taken substantially along the line 2—2 in FIG. 1.
Figure 3:
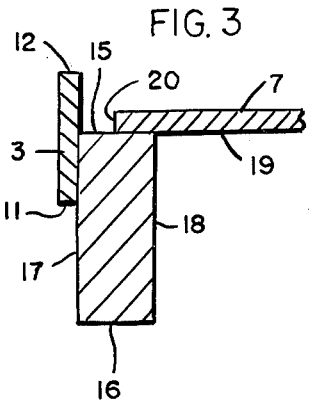
FIG. 3 is a detail sectional view taken substantially along the line 3—3 in FIG. 2.

In FIGS. 1-3 of the drawings, a protector device 1, embodying the principles of the present invention, is shown mounted in a dishwashing machine 2, to illustrate the presently preferred embodiment of the present invention.

The protector device 1 embodies an annular member or ring 3, having two substantially L-shaped mounting brackets 4 and 5 mounted thereon, and a baffle member 6 mounted in the annular member 3, the baffle member 6 embodying a disk or plate 7 having three mounting members or supporting members 8, 9 and 10 mounted thereon.

The annular member 3 preferably is round in transverse cross section, and may be made of any suitable material, such as, for example, sheet steel. The annular member 3 preferably is substantially cylindrical in shape and has two outer edges 11 and 12, which, preferably, are disposed in substantially parallel relation to each other.

Each of the supporting members or mounting brackets 4 and 5 embodies two legs 13 and 14 disposed in substantially perpendicular relation to each other. The brackets 4 and 5 may be made of any suitable material, such as, for example, sheet steel, and preferably are disposed on diametrically opposite sides of the annular member 3, with the legs 13 thereof disposed in engagement with the inner face of the annular member 3 and secured thereto by suitable means, such as, for example, welding, in position to dispose the legs 14 thereof in outwardly spaced parallel relation to the edge 11 of the annular member 3. In the preferred form of the invention shown in the drawings, the brackets 4 and 5 are mounted on the interior surface of the annular member 3, with the legs 14 projecting toward each other. However, as will be appreciated by those skilled in the art, this is merely by way of illustration and not by way of limitation, and, if desired, the legs 13 may be disposed on the external surface of the annular member 3, and the brackets 4 and 5 may be disposed in position wherein the legs 14 project away from each other, without departing from the purview of the broader aspects of the present invention.

The disk 7 of the baffle member 6, preferably is in the form of a substantially flat disk or plate, and, like the annular member 3, preferably is substantially round in transverse cross section, FIG. 2. It is smaller in diameter than the internal diameter of the annular member 3, and may be made of any suitable material, such as, for example, sheet steel.

The supporting members 8–10 are identical in construction, and each comprises a substantially flat, rectangular shaped member having two oppositely disposed substantially parallel end edges 15 and 16 and two oppositely disposed, substantially parallel side edges 17 and 18, FIG. 3. They, also, may be made of any suitable material, such as, for example, sheet steel.

Preferably, the mounting members 8–10 are disposed around the disk 7 in equally spaced relation to each other, with the end edges 15 thereof disposed in abutting engagement with one of the faces 19 of the disk 7, and secured thereto by suitable means, such as, for example, welding. The supporting members 8–10 are disposed in radially outwardly projecting relation to the disk 7 with the side edges 17 thereof projecting outwardly from the outer periphery 20 of the disk 7 such a distance that, when the baffle member 6 is disposed in operative position in the annular member 3, the side edges 17 of the supporting members 9 engage the internal surface of the baffle member 3 with a relatively snug but freely slidable, frictional fit, to thereby dispose the disk 7 in uniformly inwardly spaced relation to the annular member 3 around the outer periphery of the disk 7, FIG. 2. Preferably, the supporting members 8–10 are of such length that, when the baffle member 6 is disposed in normal, operative position in the annular member 3, the end edges 16 thereof are disposed in uniplanar relation to the sides of the legs 14 shown in contact with sidewall 23 remote from the legs 13 of the mounting brackets 4 and 5, and the disk 7 is disposed between, and in spaced relation to the edges 11 and 12 of the annular member 3, FIG. 1.

In FIGS. 1 and 2, the protector device 1 is shown mounted in operative position relative to a drain opening 22 in an upright sidewall 23 of a sump 24 in the dishwasher 2. The dishwasher 2 may be of any suitable type, such as, for example, the type disclosed in U.S. Pat. No. 3,108,607, issued to D. G. Blakeslee on Oct. 29, 1963.

The sump 24 of the dishwasher 2, shown in the drawings, is substantially rectangular in transverse cross section, and embodies a sidewall 25 disposed in substantially parallel relation to the sidewall 23, FIG. 1, and two substantially parallel, upright sidewalls 26 and 27, FIG. 2, extending between the sidewalls 23 and 25. The sump 24 has a bottom wall 28, having a drain 29 disposed therein, and a standpipe 30 extends upwardly from the drain 29 for controlling the level of the water in the machine 2 in the usual manner. In the machine 2, shown in the drawings, screens 31, preferably in the form of removable screens, are shown disposed above the standpipe 30 in position to prevent material, greater than a predetermined size, passing downwardly from the dishwashing chamber of the machine 2, above the screens 31, into the water therebelow. When the screens 31 are disposed in operative position, they normally are effective to protect against the dangers that it is intended that the present invention protect against, namely, the passage of silverware, or the like, into or through the drain opening 22. However, as previously mentioned, such screens must be opened or removed, periodically, for cleaning, and if they are accidentally dislodged or left open larger articles, such as, for example, even silverware, and the like, may pass downwardly from the dish-washing portion of the machine 2, and it is an important object of the present invention to prevent such articles from damaging the machine 2, if this occurs, as will be discussed in greater detail presently.

In FIG. 1, a pump 32, having an inlet opening 33, is shown disposed in operative position on the outer face of the sidewall 23 of the sump 24, with the inlet opening 33 disposed in operative, axial alignment with the outlet opening 22 in the sump 24. The pump 32 may be of any suitable type, such as, for example, a pump of the type disclosed in the aforementioned D. G. Blakeslee U.S. Pat. No. 3,108,607, and embodies a motor 34 for driving an impeller 35, the impeller 35 being disposed inwardly of the inlet opening 33 in closely disposed relation thereto. The inlet opening 33 is disposed in a sidewall 36 of the pump 32, the sidewall 36 being disposed in parallel, juxtaposition to the sidewall 23 of the sump 24.

In the machine 2, the legs 14 of the mounting brackets 4 are secured to the inner face of the sidewall 23 of the sump 24, in parallel juxtaposition thereto, by suitable means, such as bolts or screws 37. The mounting brackets 4 and 5 are so disposed on the sidewall 23 that the annular member 3 is disposed on a common longitudinal axis with, but in radially outwardly disposed relation to the outlet opening 22 in the sidewall 23 and the inlet opening 33 in the pump 32. The baffle member 6 of the protector device 1 is mounted in the annular member 3 in such position that, when the free end edges 16 of the supporting members 8–10 are disposed in abutting engagement with the inner face of the sidewall 23 of the sump 24, the disk 7 of the baffle member 6 is disposed a substantial distance inwardly from the edge 12 of the annular member 3, for a purpose which will be discussed in greater detail presently. In the preferred form of the present invention, both the annular member 3 and the disk 7 of the baffle member 6 are of substantially greater diameter than the outlet opening 22, as will be discussed in greater detail presently.

As will be appreciated by those skilled in the art, during the operation of a dishwashing machine, such as the machine 2, water or liquid is pumped from the sump 24 outwardly through the openings 22 and 33 by the pump 32 and is fed back into the dish-washing portion of the machine 2, from which the water or other liquid flows back down through the screens 31 into the lower portion of the machine 2, including the sump 24. This flow of liquid is normally at a substantial rate, such as, for example, two-hundred gallons per minute. The present invention permits such flow of liquid while affording effective protection against the passage of objects, such as silverware, and the like, through the opening into the pump 32, afforded by the outlet opening 22 in the sump 24 and the inlet opening 33 in the pump 32, into position wherein it can damage the impeller 35 or other portions of the pump 32.

Thus, for example, if the openings 22 and 33 are each four inches in diameter, and the walls 23 and 36 are each one tenth of an inch thick, affording an opening thickness of two tenths of an inch into the pump 32, such flow may be effected by the usual pumps, readily available on the market, with the protector device 1 disposed in the aforementioned operative position on the sidewall 23 of the sump 24, when, for example, the protector device 1 is so constructed, and is so disposed in position that: the width of the annular member 3, between the edges 11 and 12 thereof is one and one-quarter inches; the annular member 3 is made of fourteen gauge steel, having an outside diameter of seven inches; the mounting brackets 4 and 5 project from the annular member 3 such a distance that the edge 11 thereof is disposed three quarters of an inch from the interior surface of the sidewall 23 of the sump 24; the disk 7 is made of twelve gauge stainless steel and has an outside diameter of six inches; and the supporting members 8–10 project from the disk 7 a distance of one and one-quarter inches. It has been found that, with this construction, and with the protector device 1 mounted in the aforementioned manner in a dishwashing machine, such as the machine 2, ample passageway is afforded between the edge 11 of the annular member 1 and the sidewall 23 of the sump 24 and between the disk 7 and the annular member 3 to accommodate a practical volume of flow of liquid, such as the aforementioned two hundred gallons per minute, from the sump 24 into the inlet 33 of a pump, such as the pump 32. Of equal, if not greater importance, is the fact that with this construction of the protector device 1, and with the device 1 so mounted around a passageway of the size afforded by the passageways 22 and 33, effective protection is afforded against the passage of elongated articles of the type normally to be found in dishwashing machines, such as, for example, silverware, and the like, through the protector device 1 into the pump 32 past the inlet opening 33 thereof.

Thus, with the protector device 1 mounted in the operative position shown in FIG. 1, but even with the wall 23 being a smooth wall without any obstructions thereon, such as are afforded by the overhanging flange 38, and the bottom wall 28 of the sump 24, the protector device 1 would be effective to prevent a straight, elongated object, having a length of at least 5.6" and a thickness of at least 0.48" from passing between the edge 11 of the annular member 3 and the sidewall 23 of the sump 24 into the pump 32 through the inlet opening 33 thereof. Using this same construction, except that the edge 11 of the annular member 3 is spaced from the sidewall 23 of the sump 24 one-half inch, the minimum article thickness protected against is reduced to 0.35".

Thus, with such construction, and with the protector device 1 so mounted in the dishwashing machine 2, it obviously affords effective protection against articles such as the usual tableware, and the like, passing between the sidewall 23 and the annular member 3 and through the openings 22 and 33 into the pump 32, while affording a passageway of substantial size for liquid.

Also, of course, by changing nothing with respect to the above described construction and mounting of the protector device 1, except to move the annular member 3 and disk 7 in closer to the wall 33 (by appropriately shortening the mounting brackets 4 and 5 and the supporting members 8–10) and increasing the space between the annular member 3 and the disk 7, to make up for the loss of fluid flow between the edge 11 of the annular member 3 and the sidewall 23, the minimum thickness of an elongated member of the aforementioned length that is afforded absolute protection against passing between the annular member 3 and the wall 23 into the pump 32 may be decreased until, when the distance between the annular member 3 and the wall 23 has been reduced to 0.075", such an elongated member having any finite thickness, at all, will not so pass.

In the embodiment of the invention shown in the drawings, the protector device 1 is mounted on the sidewall 23 of the sump 24 below a flange 38 that projects outwardly from the sidewall 23 into overlapping, parallel relation to the annular member 3. This construction affords additional protection against articles such as silverware, and the like, passing into the pump 32, because such articles normally will be falling downwardly, substantially vertically, from the dishwashing portion of the machine 2 and, when they strike the flange 38 will be deflected outwardly away from the passageway afforded between the edge 11 of the annular member 3 and the sidewall 23 of the sump 24.

Also, with respect to the passageway afforded by the spacing of the outer periphery of the disk 7 from the interior surface of the annular member 3, it is to be observed that if an article were to be moving from right to left, as viewed in FIG. 1, into such a passageway, the construction of the protector device 1 having the aforementioned dimensions, would protect against the passage of an article, having the aforementioned length of 5.6", into the pump 32 through that passageway, irrespective of the thickness of such an article, the edge 12 of the tubular member 3 and the outer periphery of the disk 7 of the baffle member 6 being so disposed relative to each other that such a piece of silverware disposed between the annular member 3 and the baffle member 6 can not slope inwardly toward the opening 22 enough to permit the piece of silverware to enter the opening 22.

It is to be remembered that, in the preferred form of the protector device 1, shown in the drawings, the baffle member 6 is slidably mounted in the annular member 3. With this construction, when the baffle member 6 is disposed in normal operative position in the annular member 3, the flow of water therepast is effective to hold it in its normal position, with the end edges 16 of the supporting members 8–10 disposed in abutting relation to the interior surface of the sidewall 23 of the sump 24. However, if it is desired to gain access to the interior of the protector device 1, such as, for example, for the purpose of gaining access to the impeller 35 of the pump 32, this may be readily accomplished by merely manually pulling the baffle member 26 axially outwardly through the annular member 3 away from the wall 23 of the sump 24. The baffle member 6 may equally readily be inserted back into operative position in the annular member 3 by manually inserting the supporting members 8–10 into the latter and pushing the baffle member 6 back into position in the annular member 3 wherein the supporting members 8–10 again abuttingly engage the wall 23 of the sump 24.

It is to be observed that although, in the preferred form of the invention, the protector device 1 is disposed on an upright sidewall, this is merely by way of illustration and not by way of limitation, and the protector device 1 is adapted to be mounted, and could be mounted on other walls, such as, for example, a bottom wall, with the annular member 3 disposed in upwardly projecting relation thereto, without departing from the purview of the broader aspects of the present invention.

From the foregoing, it will be seen that the present invention affords a novel protector device for drain openings, and the like.

Also, it will be seen that the present invention affords a novel protector device, which is particularly well adapted for use in guarding against the entry of silverware, and the like, into the pump of a dishwashing machine, or the like.

In addition, it will be seen that the present invention affords a novel protector device for drains, which is practical and efficient in operation and which may be readily and economically produced commercially.

Thus, while I have illustrated and described the preferred embodiment of my invention, it is to be understood that this is capable of variation and modification, and I therefore do not wish to be limited to the precise details set forth, but desire to avail myself of such changes and alterations as fall within the purview of the following claims.

I claim:

1. A protector device for use on the interior of a wall having a drain opening therein for guarding against elongated articles passing outwardly through said drain opening, said device comprising
   a. an annular member having substantially greater axial length than radial width between the inner and outer periphery of said member
   b. means for supporting said annular member on said wall in axially outwardly spaced and radially outwardly spaced relation to said drain opening therein, and
   c. a baffle member comprising
      (1) a disk, and
      (2) means supporting said disk in said annular member in substantially perpendicular relation to the longitudinal axis of the latter,
   d. the outer periphery of said disk being disposed in radially inwardly spaced relation to said annular member.

2. A protector device as defined in claim 1, and in which
   a. said means supporting said disk comprise members attached to said disk and projecting outwardly therefrom into engagement with said annular member.

3. A protector device as defined in claim 2, and in which
   a. said baffle member is slidably mounted in said annular member for removal therefrom and insertion thereinto axially of said annular member, and
   b. said supporting means members comprise substantially rectangular shaped plate members, each having
      (1) one end attached to said disk,
      (2) a longitudinal side
         (a) disposed radially outwardly of said disk, and
         (b) disposed in frictional engagement with the internal surface of said annular member, and
      (3) another end for abuttingly engaging said wall when said protector device is so supported thereon, and said disk is disposed in a predetermined position in said annular member.

4. A protector device for use in a machine embodying a wall having a drain opening therethrough, a pump mounted on the exterior of said wall for pumping liquid from the interior of said machine, said pump having an inlet opening disposed in position to receive fluid from the interior of said machine through said drain opening, said protector device being for the purpose of preventing elongated articles from entering said drain opening from the interior of said machine and comprising
   a. an annular member having two axially spaced outer edges,
   b. means for supporting said annular member on the interior of said wall in position wherein
      (1) said annular member is disposed in substantially axial alignment with said drain opening, and
      (2) one of said edges is disposed in outwardly spaced, facing relation to the interior of said wall to define a passageway between said one edge and said wall for the passage of fluid from outwardly of said annular member into said drain opening,
   c. said annular member being of greater cross-sectional width, than said drain opening, when said annular member is so disposed on said wall, and
   d. a baffle member disposed in said annular member in position to define with said annular member, a passageway through the interior of said annular member, radially outwardly of said drain opening, for the passage of fluid through said annular member from outside the other of said edges for passage between said annular member and said baffle member into said drain opening, when said annular member is so disposed on said wall.

5. A protector device as defined in claim 4, and in which
   a. said baffle member is mounted in said annular member by a plurality of supporting members
      (1) mounted on said baffle member in spaced relation to each other, and
      (2) projecting outwardly from said baffle member into engagement with said annular member.

6. A protector device as defined in claim 5, and in which
   a. said baffle member is movable axially of said annular member.

7. A protector device as defined in claim 4, and in which
   a. said annular member comprises a wall having a greater width, in the direction parallel to the longitudinal axis of said annular member than the thickness of said last mentioned wall transverse to said longitudinal axis,
   b. said means supporting said annular member comprise a plurality of mounting brackets
      (1) mounted on said last mentioned wall in spaced relation to each other, and
      (2) projecting from said one edge toward said first mentioned wall.

8. A protector device as defined in claim 7, and in which
   a. said baffle member is movably mounted in said annular member for
      (1) removal axially outwardly therefrom in a direction away from said first mentioned wall, and
      (2) insertion axially thereinto in a direction toward said first mentioned wall.

9. A protector device as defined in claim 8, and in which a. said baffle member is mounted in said annular member by a plurality of supporting members
(1) mounted on said baffle member in spaced relation to each other, and
(2) projecting outwardly from said baffle member into engagement with said annular member, and
b. said supporting members project from said annular member into engagement with said first mentioned wall when said baffle member is disposed in fully inserted position in said annular member.

10. A protector device as claimed in claim 9, and in which
a. said annular member is substantially round in shape,
b. said baffle member comprises
(1) a substantially flat plate which is round in shape and smaller in outside diameter than the inside diameter of said annular member, and
(2) said supporting members are attached to one face of said plate.

11. In a dishwashing machine having an upstanding wall having an outlet opening therethrough, a pump having an inlet opening, and mounted on the exterior of said wall in position to receive liquid from the interior of said machine through said outlet and inlet openings and pump said liquid back into said machine, the combination of
a. an annular member having
(1) two opposite, axially spaced outer edges,
(2) greater length between said edges, axially of said annular member, than the radial width between the inner and outer periphery of said annular member, and
(3) a larger diameter than that of said outlet opening,
b. a plurality of substantially L-shaped mounting brackets having
(1) one leg attached to said annular member, and
(2) another leg secured to said wall for supporting said annular member on said wall in inwardly spaced relation thereto and in axially aligned, radially outwardly disposed relation to said outlet opening, and
c. baffle member removably mounted in said annular member,
d. said baffle member comprising
(1) a substantially flat plate having an outside diameter that is greater than the diameter of said outlet opening and less than the inside diameter of said annular member, and
(2) a plurality of supporting members having
(a) one end attached to one face of said plate in spaced relation to each other,
(b) one side edge disposed in frictional engagement with the interior of said annular member, and
(c) another end disposed in abutting engagement with said wall when said plate is disposed in predetermined position in said annular member between said outer edges.

* * * * *